US011058959B2

(12) United States Patent
Tresaugue et al.

(10) Patent No.: US 11,058,959 B2
(45) Date of Patent: Jul. 13, 2021

(54) VERTICAL MOTION DRIVE SYSTEM FOR A RIDE SYSTEM

(71) Applicant: Universal City Studios LLC, Universal City, CA (US)

(72) Inventors: Michael Joseph Tresaugue, Windermere, FL (US); Lisa Marie Levy, Orlando, FL (US); Michael Keith Brister, Winter Garden, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 16/588,607

(22) Filed: Sep. 30, 2019

(65) Prior Publication Data

US 2020/0289949 A1 Sep. 17, 2020

Related U.S. Application Data

(60) Provisional application No. 62/818,457, filed on Mar. 14, 2019.

(51) Int. Cl.
*A63G 9/16* (2006.01)
*A63G 31/00* (2006.01)

(52) U.S. Cl.
CPC ..... *A63G 9/16* (2013.01); *A63G 31/00* (2013.01)

(58) Field of Classification Search
CPC . A63G 9/16; A63G 31/00; A63G 7/00; A63G 21/14; A63G 31/02; A63G 5/00; A63G 31/10; A63G 31/16; A63J 21/00; A63J 5/02; A63J 5/021; A63J 5/12; A63J 1/028; B66B 9/00; B66B 1/36; B66B 11/043; B66B 9/027; B66B 5/00; B66B 7/10; B66B 11/08; B66F 11/04; E04H 6/12
USPC ..... 472/119, 60, 43, 131; 104/53; 414/786; 187/254; 254/286
See application file for complete search history.

(56) References Cited

U.S. PATENT DOCUMENTS

| | | | |
|---|---|---|---|
| 482,736 | A | 9/1892 | Hardy |
| 3,101,130 | A | 8/1963 | Bianca |
| 3,750,849 | A | 8/1973 | Berkovitz |

(Continued)

FOREIGN PATENT DOCUMENTS

| | | |
|---|---|---|
| JP | H01313082 | 12/1989 |
| JP | 2001054682 | 2/2001 |

OTHER PUBLICATIONS

PCT/US2020/020608 International Search Report and Written Opinion dated May 25, 2020.

*Primary Examiner* — Michael D Dennis
(74) *Attorney, Agent, or Firm* — Fletcher Yoder, P.C.

(57) ABSTRACT

A ride system includes a platform assembly that receives a ride vehicle for transporting a ride passenger, an upward drive pulley system, and a downward drive pulley system. The upward drive pulley system is drivingly coupled to the platform assembly and upwardly drives motion of the platform assembly along a vertical axis oriented along a gravity vector. The downward drive pulley system is drivingly coupled to the platform assembly and downwardly drives motion of the platform assembly along the vertical axis. Additionally, upwardly and downwardly driving motion of the platform assembly exposes the ride passenger to a plurality of entertainment shows, and the entertainment shows are positioned on a different vertical level with respect to one another.

20 Claims, 8 Drawing Sheets

(56) References Cited

U.S. PATENT DOCUMENTS

| | | | | |
|---|---|---|---|---|
| 5,628,690 | A | 5/1997 | Spieldiener et al. | |
| 5,957,779 | A | 9/1999 | Larson | |
| 6,315,674 | B1 * | 11/2001 | Slade | A63G 31/00 472/131 |
| 7,316,296 | B2 * | 1/2008 | Hashiguchi | B66B 9/00 187/254 |
| 7,878,306 | B2 * | 2/2011 | Siewert | B66B 11/08 187/264 |
| 8,033,528 | B2 | 10/2011 | Hoffend, III | |
| 9,266,028 | B2 | 2/2016 | Alfieri et al. | |
| 9,302,190 | B1 | 4/2016 | Jennings | |
| 9,303,421 | B1 | 4/2016 | Jennings | |
| 9,732,535 | B2 | 8/2017 | Jennings | |
| 2002/0068640 | A1 * | 6/2002 | Uemura | A63G 31/16 472/60 |
| 2007/0265103 | A1 * | 11/2007 | Roodenburg | A63G 31/02 472/43 |
| 2013/0019771 | A1 * | 1/2013 | Gmeinwieser | A63G 7/00 104/53 |
| 2013/0324271 | A1 * | 12/2013 | Stoker | A63G 31/10 472/71 |
| 2014/0353089 | A1 | 12/2014 | Shani et al. | |
| 2015/0141161 | A1 | 5/2015 | Alfieri et al. | |
| 2015/0158702 | A1 * | 6/2015 | Dudde | B66B 7/06 187/255 |
| 2017/0225084 | A1 * | 8/2017 | Snyder | A63G 7/00 |
| 2017/0275137 | A1 * | 9/2017 | Jacobs | B66B 11/0095 |
| 2017/0362063 | A1 * | 12/2017 | Watson | B66B 11/0045 |
| 2018/0327227 | A1 * | 11/2018 | Hollowell | B66B 11/008 |
| 2019/0127177 | A1 * | 5/2019 | Derbarmdiger | B66B 1/26 |

* cited by examiner

VERTICAL MOTION DRIVE SYSTEM FOR A RIDE SYSTEM

CROSS REFERENCE TO RELATED APPLICATIONS

This application claims priority to and the benefit of U.S. Provisional Patent Application No. 62/818,457, entitled "Vertical Motion Drive System for a Ride System," filed Mar. 14, 2019, which is hereby incorporated by reference in its entirety for all purposes.

BACKGROUND

The present disclosure relates generally to amusement park-style rides, and more specifically to systems for controlling motion of a ride vehicle of the amusement park-style rides via a motion drive system of a ride system.

Generally, amusement park-style rides include one or more ride vehicles that carry ride passengers along a ride path, for example, defined by a track. Over the course of the ride, the ride path may include a number of features, including tunnels, turns, inclines, declines, loops, and so forth. The direction of travel of the ride vehicle may be defined by the ride path, as rollers of the ride vehicle may contact the tracks or other features defining the ride path. In this manner, traditional amusement park-style rides employing only tracks to define the ride path may limit the overall thrill and excitement experienced by ride passengers. Furthermore, controlling vertical motion (e.g., motion having a component oriented substantially parallel to the gravity vector) of the ride vehicle may be unfeasible for these amusement park-style rides employing only tracks. For instance, vertical motion of the ride vehicle may subject the tracks and components of the ride vehicle in contact with these tracks to undesirable loads. Accordingly, while it may be desirable to control vertical motion of a ride vehicle in such a manner that the ride experience is enhanced, in certain existing motion-based amusement park-style rides, controlling vertical motion may be difficult to achieve, coordinate, and implement in practice. Thus, it is now recognized that a need exists for systems capable of achieving vertical motion and controlling the vertical motion in a more efficient manner.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, a ride system includes a platform assembly that receives a ride vehicle transporting a ride passenger, an upward drive pulley system, and a downward drive pulley system. The upward drive pulley system is drivingly coupled to the platform assembly and upwardly drives motion of the platform assembly along a vertical axis oriented along a gravity vector. The downward drive pulley system is drivingly coupled to the platform assembly and downwardly drives motion of the platform assembly along the vertical axis. Additionally, upwardly and downwardly driving motion of the platform assembly exposes the ride passenger to a plurality of entertainment shows, in which the entertainment shows are positioned on a different vertical level with respect to one another.

In an embodiment, a method for controlling ride vehicle motion includes positioning and securing a ride vehicle on a platform assembly drivingly coupled to a motion drive system. The motion drive system includes an upward drive pulley system that upwardly drives motion of the platform assembly and a downward drive pulley system that downwardly drives motion of the platform assembly. The method further includes coordinating ride vehicle motion with a plurality of entertainment shows positioned on corresponding levels by vertically displacing the platform assembly, such that coordinating ride vehicle motion includes instructing a first entertainment show of the plurality of entertainment shows to execute a first show in response to the ride vehicle being positioned within a first vertical distance range. Furthermore, coordinating ride vehicle motion includes instructing a second entertainment show of the plurality of entertainment shows to execute a second show in response to the ride vehicle being positioned within a second vertical distance range. The second vertical distance range is above the first vertical distance range. The ride vehicle transitions from the first vertical distance range to the second vertical distance range in response to the upward drive pulley system upwardly driving motion of the platform assembly. In addition, the ride vehicle transitions from the second vertical distance range to the first vertical distance range in response to the downward drive pulley system downwardly driving motion of the platform assembly.

DRAWINGS

These and other features, aspects, and advantages of the present disclosure will become better understood when the following detailed description is read with reference to the accompanying drawings in which like characters represent like parts throughout the drawings, wherein.

Figure 2:
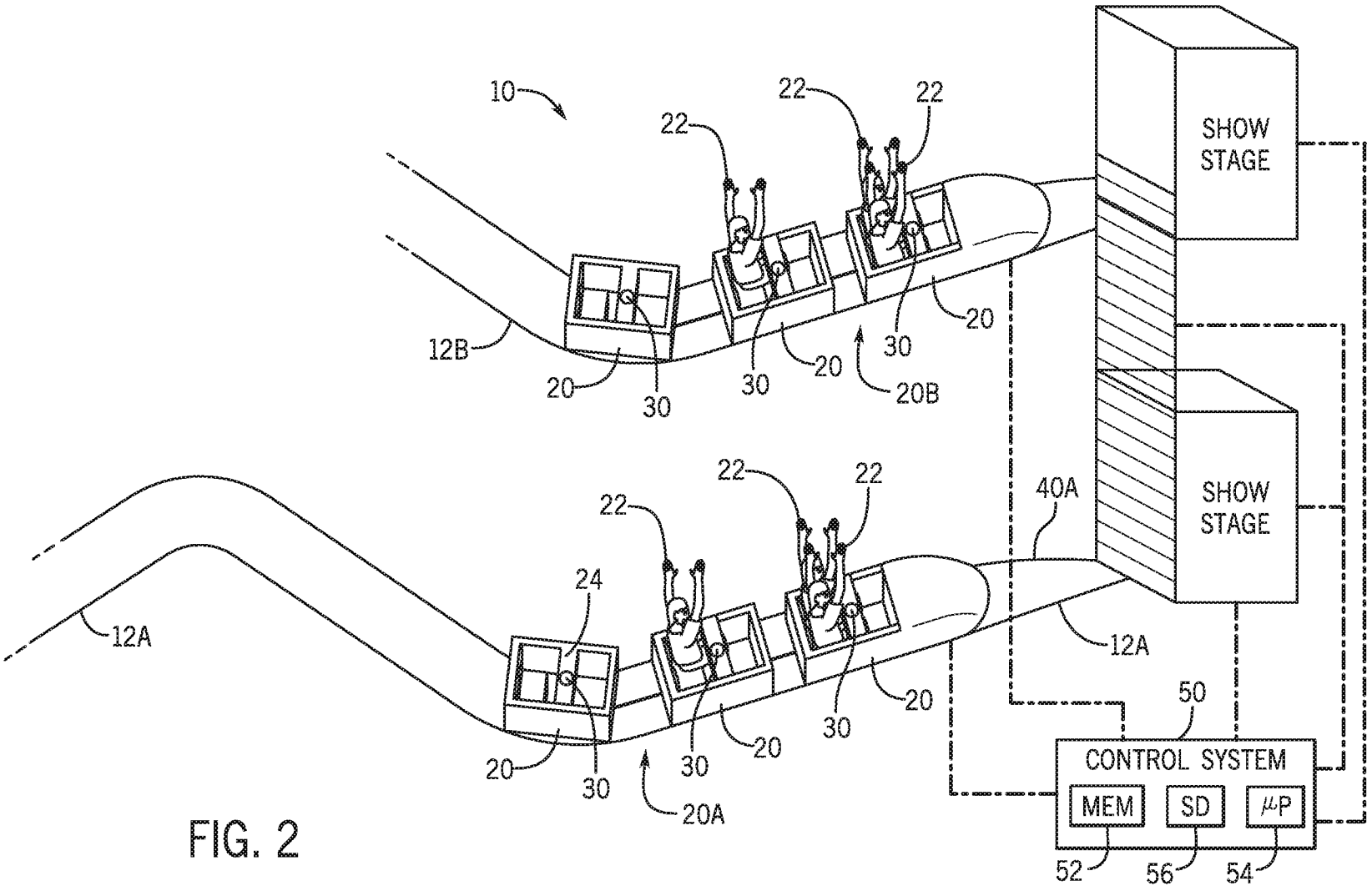
FIG. 2 is a perspective view of an embodiment of a ride system employing the motion drive system of FIG. 1, in accordance with aspects of the present disclosure.
Figure 3:
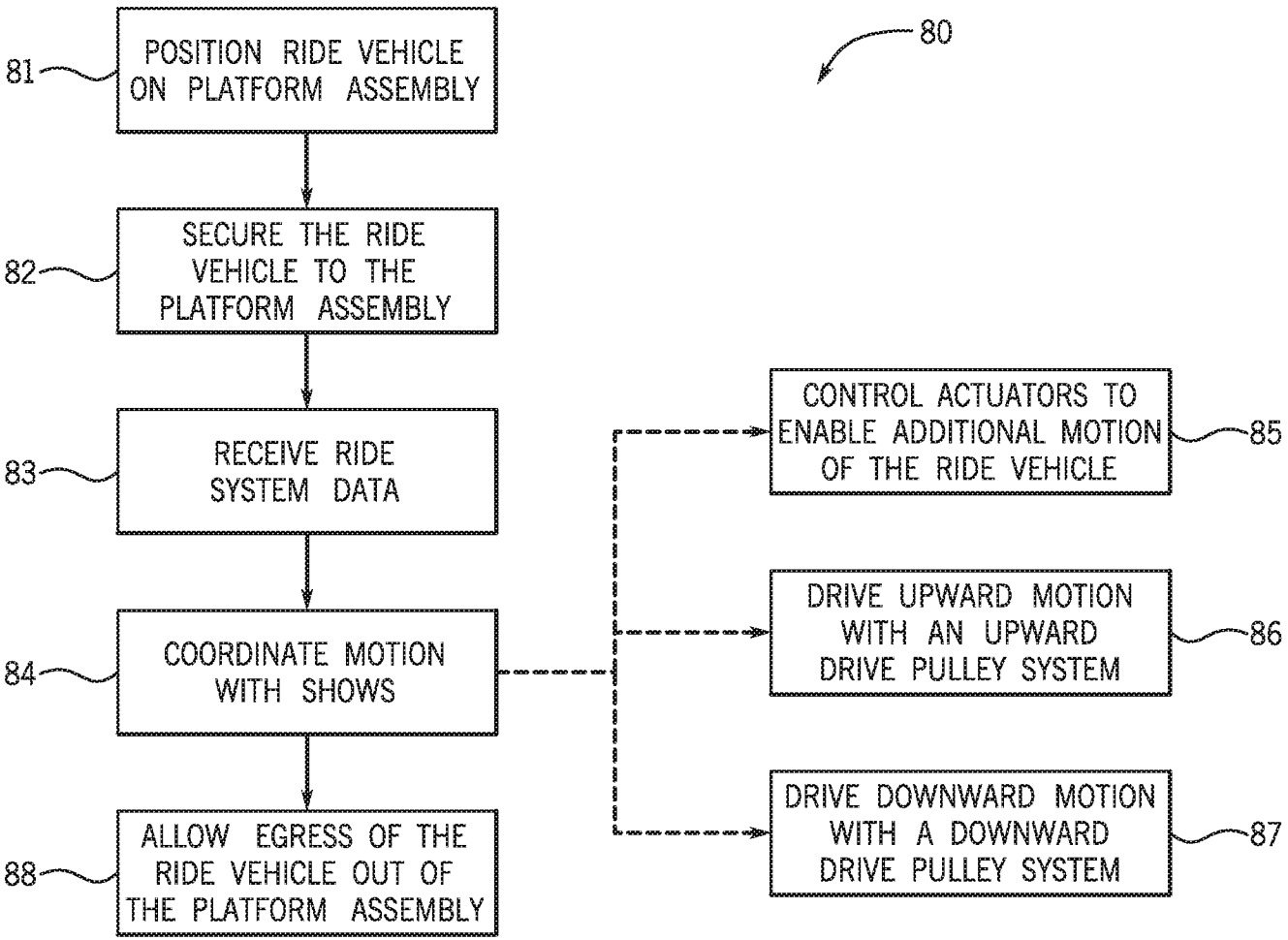
FIG. 3 is a flow diagram of an embodiment of a process for controlling motion of a ride vehicle operating in the ride system of FIG. 2 by using the motion drive system of FIG. 1, in accordance with aspects of the present disclosure.
Figure 6:
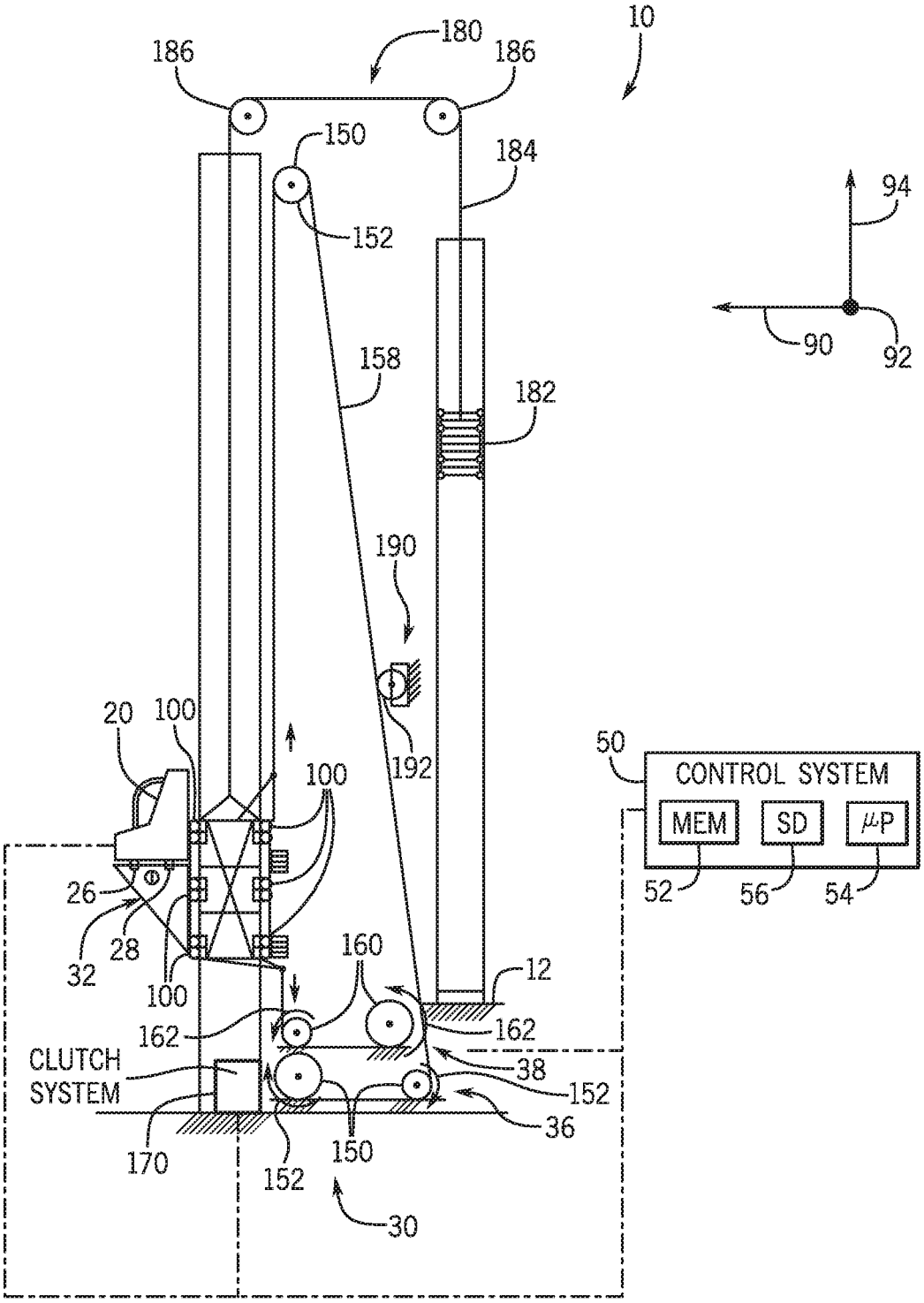
FIG. 6 is a side elevation view of an embodiment of a motion drive system operating in the ride system of FIG. 2, in accordance with aspects of the present disclosure.
Figure 7:
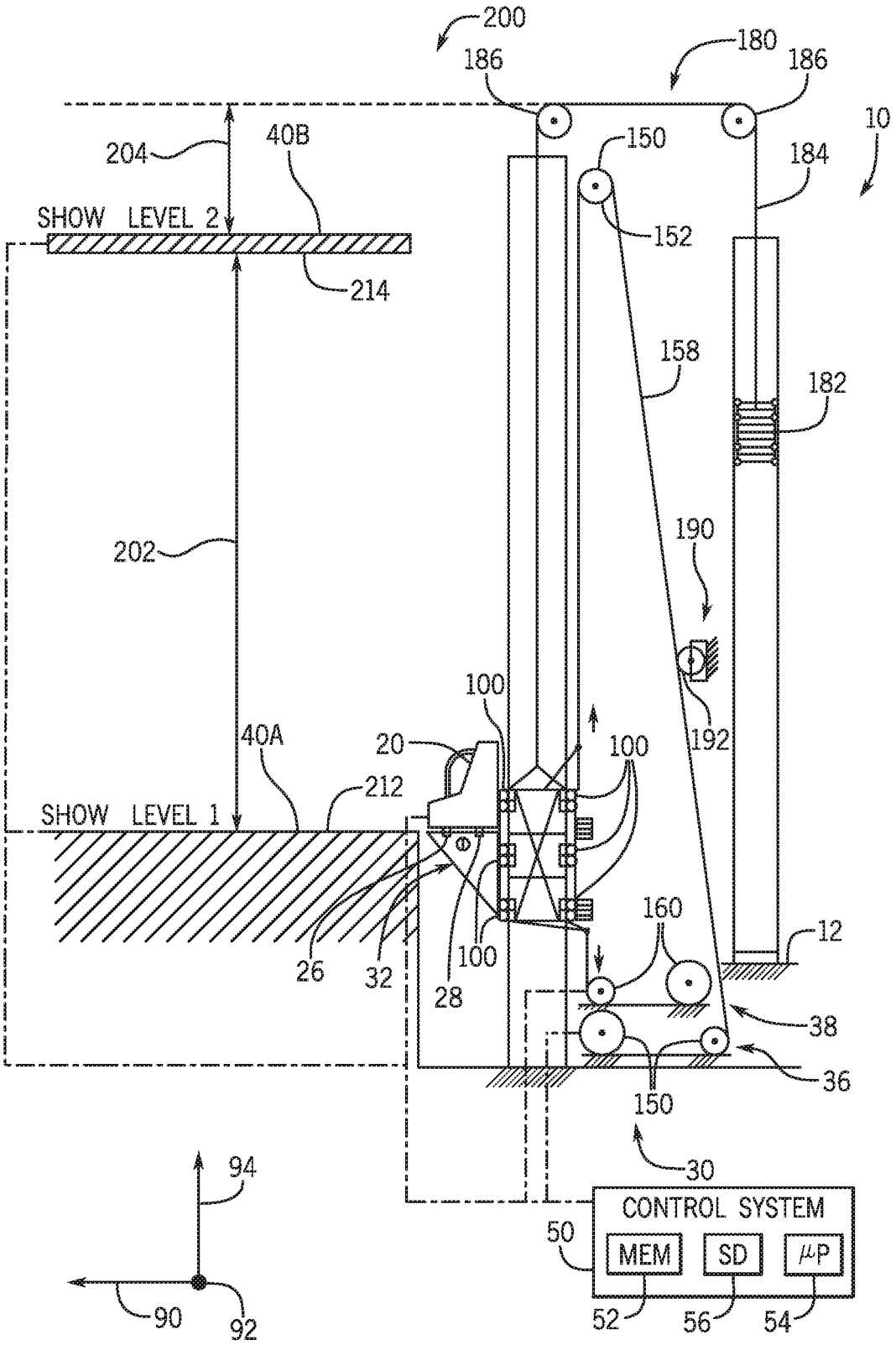
Figure 8:
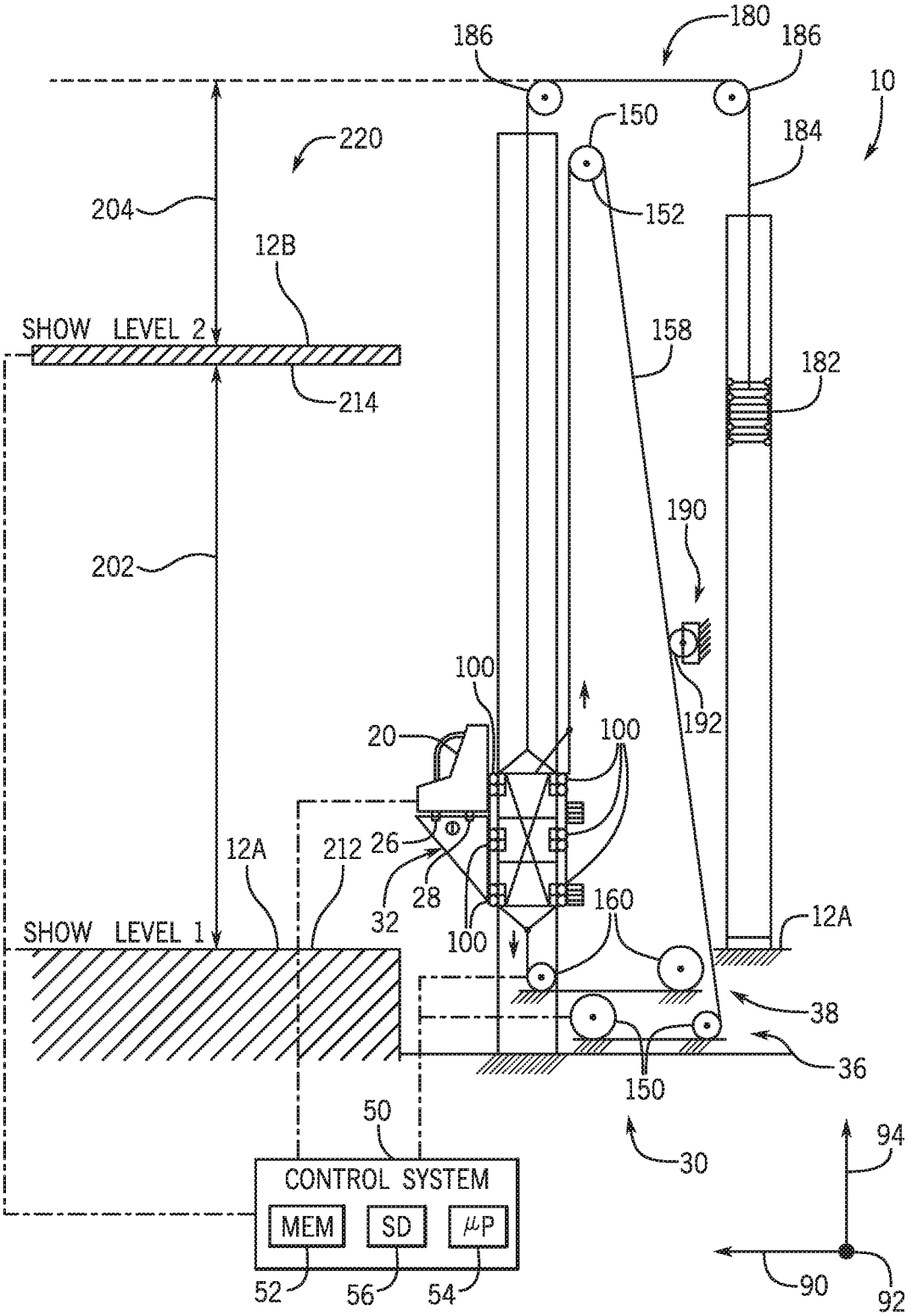

FIG. 7 is a side elevation view of an embodiment of the motion drive system of FIG. 6 configured to coordinate motion between levels in a ride environment associated with the ride system of FIG. 2, in accordance with aspects of the present disclosure; and FIG. 8 is a side elevation view of an embodiment of the motion drive system of FIG. 6 causing vertical motion of the ride vehicle of FIG. 3 to coordinate motion between one or more entertainment show, in accordance with aspects of the present disclosure.

DETAILED DESCRIPTION

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

With this in mind, one or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

While the following discussion is generally provided in the context of amusement park-style rides that may include a plurality of pulley systems to drive motion of a ride vehicle, it should be understood that the embodiments disclosed herein are not limited to such entertainment contexts. Indeed, the provision of examples and explanations in such an entertainment application is to facilitate explanation by providing instances of real-world implementations and applications. As such, it should be appreciated that the embodiments disclosed herein may be useful in other applications, such as transportation systems (e.g., train systems, building and floor connecting systems), elevator systems, and/or other industrial, commercial, and/or recreational human transportation systems, to name a few.

With the forgoing in mind, present embodiments include systems and methods for controlling motion of a ride vehicle operating within a ride system. For example, ride systems, such as the above-referenced amusement park-style ride, may include one or more ride vehicles that carry ride passengers along a ride path, for example, defined by a track. Over the course of the ride, the ride path may include a number of features, including tunnels, turns, inclines, declines, loops, and so forth. The direction of travel of the ride vehicle may be defined by the ride path, for example, as rollers of the ride vehicle may be in constant contact with the tracks defining the ride path. It may be desirable to control vertical motion of the ride vehicle along a vertical axis. "Vertical motion," as used herein, may refer to motion having a component oriented substantially parallel to the gravity vector. In certain existing approaches in which roller assemblies of a ride vehicle are the sole mechanisms for driving motion of the ride vehicle along the tracks defining the ride path, achieving vertical motion of the ride vehicle may result in unwanted loads experienced by the ride vehicle, the rollers assemblies, or the tracks. Furthermore, existing approaches may result in the ride passenger always being oriented along a fixed direction relative to the ride path, which may be undesirable, as more complete control of the position and velocity of the ride passengers relative to the ride path may be desirable.

Certain embodiments of systems and methods disclosed herein may enhance the ride experience by controlling the vertical motion of the ride vehicle. The mechanisms allowing vertical motion may be hidden from the ride passenger, and unwanted loads on the ride vehicle may be reduced and/or eliminated. Aspects of the disclosed embodiments include receiving the ride vehicle from the ride path and positioning the ride vehicle on a platform assembly, as described in detail below. The platform assembly may couple to and secure the ride vehicle. After securely housing the ride vehicle (e.g., to the platform assembly), a motion drive system including pulley systems, actuatable motors, and the platform assembly, may control and coordinate vertical motion of the ride vehicle with, for example, an entertainment show on each of a plurality of levels, as discussed in detail below. The motion drive system may drive vertical motion of the ride vehicle to expose the ride passenger to entertainment shows on different levels of the ride system, such that each level is positioned at a different vertical position. Additional actuators on the ride vehicle may drive motion of the ride passengers relative to the motion drive system to further enhance the ride experience, while the motion drive system and the entertainment shows provide visual and/or physical entertainment.

To allow for control over this motion of the ride vehicle, the motion drive system may include a plurality of pulley systems, each including an actuatable winch (e.g., motor) to drive motion of a corresponding pulley cable coupled to the platform, and thereby control vertical motion of the ride vehicle. A control system may receive ride system data (e.g., position, velocity, acceleration along or about any of a longitudinal, lateral, and vertical axis for the moveable features of the ride system) from any number of sensor assemblies associated with the ride system and actuate the winches to control the motion drive system, as described in detail below. The motion drive system may include a plurality of single direction pulley systems. For example, the motion drive system may include a first pulley system for allowing upward motion of the platform assembly (and the ride vehicle) and a second pulley system for allowing downward motion of the platform assembly (and ride vehicle). The first pulley system may control upward motion of the platform assembly (and ride vehicle), while the second pulley system may control downward motion of the platform assembly to coordinate vertical motion in conjunction with the entertainment shows visible to the ride passengers on each of a plurality of levels. The motion drive system may include a clutch system that may receive control signals (e.g., control instructions) to selectively engage the first or second pulley system, and thereby control upward or downward motion of the platform assembly (and ride vehicle). In this manner, the complexities associated with multi-directional rotational winch motion may be replaced by single directional rotational winch motion, thereby reducing the complexity of existing ride systems.

The pulley systems employed in the embodiments disclosed herein may be open-loop or closed-loop pulley systems. "Open-loop" pulley systems may refer to pulley systems employing pulley cables having a first end separate from the second end. For example, a first end may couple to the platform assembly, while a second end may couple to a winch or wall. "Closed-loop pulley systems may refer to pulley systems employing pulley cables having a closed and continuous contour.

Additionally, the embodiments disclosed herein allow additional flexibility in motion. In an embodiment, the platform assembly may receive the ride vehicle and allow egression of the ride vehicle. For example, after receiving the ride vehicle, the platform assembly may vertically displace the ride vehicle and expose the ride passenger to various entertainment shows before again coupling to the ride path to allow the ride vehicle to egress the platform assembly and continue along the ride path. In another example, after receiving the ride vehicle from a first ride path, the platform assembly may vertically displace the ride vehicle and expose the ride passenger to various entertainment shows before coupling to a second ride path, positioned at a vertical distance different than the first ride path, to allow the ride vehicle to continue along the second ride path. In this manner, the motion drive system may additionally function as an elevator system that transports the ride vehicle from the first ride path to the second ride path in an experience enhancing manner.

Figure 1:
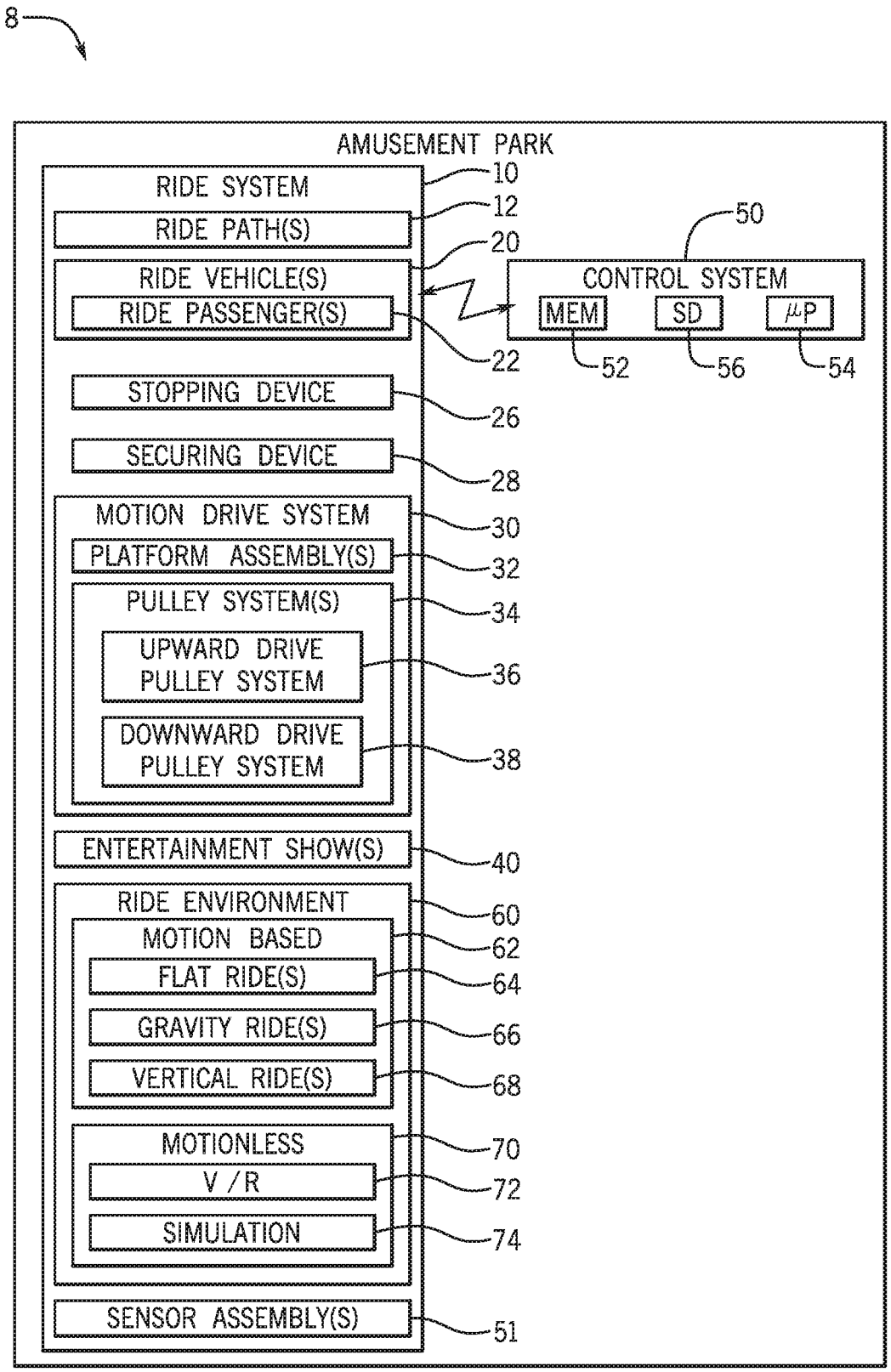
FIG. 1 is a block diagram of an embodiment of various components of an amusement park, such as a motion drive system, in accordance with aspects of the present disclosure.

To help illustrate, FIG. 1 is a block diagram of an embodiment of various components of an amusement park 8, in accordance with aspects of the present disclosure. The amusement park 8 may include a ride system 10, which includes a ride path 12 (e.g., a track) that receives and guides a ride vehicle 20, for example, by engaging with tires or rollers of the ride vehicle 20, and facilitates movement of the ride vehicle 20 (e.g., through an attraction). In this manner, the ride path 12 may define various trajectories and directions of travel that may include turns, inclines, declines, ups, downs, banks, loops, and the like. In an embodiment, the ride vehicle 20 may be passively driven or actively driven via a pneumatic system, a motor system, a tire drive system, a roller system, fins coupled to an electromagnetic drive system, a catapult system, and the like.

The ride path 12 may receive more than one ride vehicle 20. The ride vehicles 20 may be separate from one another, such that they are independently controlled or driven, or the ride vehicles 20 may be coupled to one another via any suitable linkage, such that motion of the ride vehicles 20 is coupled or linked. For example, the front of one ride vehicle 20 may be coupled to a rear end of another ride vehicle 20. Each ride vehicle 20 in these and other configurations may hold one or more ride passengers 22. In an embodiment, the ride vehicle 20 may include a turntable, a yaw drive system, or any experience-enhancing motion-based platform allowing motion of a cab housing the ride passenger 22 relative to a chassis of the ride vehicle 20. For example, the cab housing the ride passenger may move along or about a longitudinal, lateral, or vertical axis, thereby allowing six degrees-of-freedom motion of the cab relative to the chassis of the ride vehicle. The ride system 20 may include a suspension system, which may dampen motion or vibrations while the ride vehicle 20 is in operation, for example, by absorbing vibration and reducing centrifugal forces when the ride vehicle 20 executes certain motions, such as turns, at certain velocities. The suspension system may be actuated to enhance the ride experience for the ride passengers 22, for example, by stiffening, vibrating, or rotating components of the suspension system.

The ride system 10 may include a motion drive system 30 to control vertical motion of the ride vehicle 20. During vertical motion, the ride vehicle 20 may be supported by a platform assembly 32 of the motion drive system 30. The ride vehicle 20 may be driven in motion along the ride path 12 via rollers of a roller system, such that the rollers may seamlessly mate with tracks of the ride path 12. The ride vehicle 20 may travel onto a platform assembly 32, as described in detail below. In this manner, the platform assembly 32 may further define the ride path 12 in certain portions of the ride path 12. The ride passenger 22 may not feel or experience substantial vertical displacements resulting from the ride vehicle 20 transitioning from the ride path 12 (e.g., tracks defining the ride path 12) to the platform assembly 32, as the ride rollers may seamlessly transition from the ride path 12 to the platform assembly 32.

To facilitate this seamless transition, the ride system 10 may include a stopping device 26 that decelerates the ride vehicle 20 and may include a securing device 28 that secures the ride vehicle 20 to the platform assembly 32 after the ride vehicle 20 decelerates to a stop. In an embodiment, the securing device 28 may include or also function as the stopping device 26, such that the securing device 28 is integral with the stopping device 26. The stopping device 26 may include a dead end stopping pin, a damper, a spring system, a break pad system, and/or any suitable device configured to decelerate the ride vehicle 20 onto a target position on the platform assembly 32. The securing device 28 may include a hook, a ratchet system, a redundant locking mechanism, or any suitable device to lock the ride vehicle 20 in place, allowing the ride vehicle 20 to become fixed relative to the platform assembly 32 at the target position on the platform assembly 32. As may be appreciated, when the securing device 28 (and the stopping device 26) is engaged, the ride vehicle 20 may be fixed relative to the platform assembly 32. Alternatively, when the securing device 28 (and the stopping device 26) is disengaged, the ride vehicle 20 may freely egress from (or ingress into) the platform assembly 32. For example, the ride vehicle 20 may egress from the platform assembly 32 to continue traveling along the ride path 12. As discussed in detail below, the ride path to which the ride vehicle 20 egresses to may or may not be the same as the ride path from which the ride vehicle 20 is received from by the platform assembly 32. The platform assembly 32 may include the stopping device 26 and/or the securing device 28 to facilitate receiving the ride vehicle 20 and positioning the ride vehicle 20 on the platform assembly 32.

Vertical motion of the platform assembly 32 may occur in response to verification that the ride vehicle 20 is secured to the platform assembly 32. In this manner, the ride vehicle 20 (which is secured by the platform assembly 32) may displace along a vertical axis. Vertical motion of platform assembly 32 and ride vehicle 20 may be realized via one or more pulley systems 34 coupled to the platform assembly 32. The pulley systems 34 may include an upward drive pulley system 36, which may include an actuatable winch drivingly coupled to a corresponding pulley cable to drive upward motion of the platform assembly 32. The pulley systems 34 may include a downward drive pulley system 38, which may include an actuatable winch drivingly coupled to a corresponding pulley cable to drive downward motion of the platform assembly 32. The motion drive system 30 may include a clutch that may receive control signals (e.g., control instructions) to selectively engage the upward or downward drive pulley system 36, 38, and thereby control upward or downward motion of the platform assembly 32 and ride vehicle 20.

Furthermore, the pulley systems 34 may couple to the platform assembly 32 in any suitable configuration. The upward drive pulley systems 36 and the downward drive pulley systems 38 may each include pulley cables coupled to the platform assembly 32, such that the pulley cables may be independently driven by a corresponding actuatable winch. While motion of the platform assembly 32 as discussed in this example is realized via two pulley systems 34, it should be understood that any suitable number of pulley systems 34, such as one, three, four, five, ten, or any number of pulley systems 34 may be employed to control motion of the platform assembly 32. The pulley systems 34 may be in any suitable configuration, for example, such as in open-loop or closed-loop configurations.

The winches of the pulley system 34 may include any suitable motion-driving device such as a torque motor, a permanent magnetic direct current (DC) motor, an electrically excited motor, any universal alternating current (AC) motor, or any suitable electromechanical actuators (e.g., linear actuators, rotary actuators, or pneumatic actuators). To facilitate control of the winches, the winches may employ a permanent magnet, a servomechanism, and the like. The winches may include a relay or a contactor connected to one or more sensor assemblies 51 to automatically start or stop in response to control signals. The winches may employ fuses or circuit breakers to attenuate any current received by the winches. The winches may be hidden from the ride passengers 22, such that the motion driving mechanisms of the ride system 10 remain undetected by the ride passengers 22.

The pulley cable may include a cable wire of any suitable characteristics and material. For example, the pulley cable may include a steel cable having redundant features, such as a fiber core and an independent wire core. While the pulley cable may be replaced or enhanced by a chain, employing a pulley cable may result in a variety of benefits. For example, the pulley cable may be more light weight, require less maintenance, and operate more quietly than a chain.

As mentioned above, the motion drive system 30 may vertically transport the ride vehicle 20 to expose the ride passenger 22 to a plurality of entertainment shows 40. In an embodiment, the ride system 10 may include a first entertainment show 40*a* (FIG. 2) on a first level and a second entertainment show 40*b* (FIG. 2) on a second level, such that the second level is positioned on a level above the first level. By controlling vertical motion of the ride vehicle 20, the motion drive system 30 may control which entertainment show the ride passenger 22 is exposed to. The entertainment shows may include a visual projection, a screen displaying relevant theming content, a group of actors performing a skit, or any suitable experience enhancing visualization. In an embodiment, the ride passengers may engage with the entertainment shows 40.

The amusement park 8 may include a control system 50 that is communicatively coupled (e.g., via wired or wireless features) to the ride vehicle 20 and the features associated with the ride system 10. The amusement park 8 may include more than one control system 50. For example, the amusement park 8 may include one control system 50 associated with the ride vehicle 20, another control system 50 associated with the motion drive system 30, a base station control system 50, and the like. Further, each of the control systems 50 may be communicatively coupled to one another (e.g., via respective transceivers or wired connections).

The control system 50 may be communicatively coupled to one or more ride vehicle(s) 20 of the amusement park 8 via any suitable wired and/or wireless connection (e.g., via transceivers). The control system 50 may control various aspects of the ride system 10, such as the direction of travel of the ride vehicle 20 in some portions of the ride, by controlling the vertical position of the ride vehicle 20 by actuating the winches to drive motion of the upward or downward drive pulley system 36, 38. The control system 50 may receive data from sensor assemblies 51 associated with the ride system 10 to, for example, control the position and velocity of each of the winches and/or pulley cables of the pulley systems 34. In an embodiment, the control system 50 may be an electronic controller having electrical circuitry configured to process data associated with the ride system 10, for example, from the sensor assemblies 51 via transceivers. Furthermore, the control system 50 may be coupled to various components of the amusement park 8 (e.g., park attractions, park controllers, and wireless networks).

The control system 50 may include memory circuitry 52 and processing circuitry 54, such as a microprocessor. The control system 50 may also include one or more storage devices 56 and/or other suitable components. The processing circuitry 54 may be used to execute software, such as software stored on the memory circuitry 52 for controlling the ride vehicle 20 and any components associated with the ride system 10 (e.g., the stopping device 26, the securing device 28, the platform assembly 32, and the pulley system 34). Moreover, the processing circuitry 54 may include multiple microprocessors, one or more "general-purpose" microprocessors, one or more special-purpose microprocessors, and/or one or more application-specific integrated circuits (ASICS), or some combination thereof. For example, the processing circuitry 54 may include one or more reduced instruction set (RISC) processors.

The memory circuitry 52 may include a volatile memory, such as random-access memory (RAM), and/or a nonvolatile memory, such as read-only memory (ROM). The memory circuitry 52 may store a variety of information and may be used for various purposes. For example, the memory circuitry 52 may store processor-executable instructions (e.g., firmware or software) for the processing circuitry 54 to execute, such as instructions for controlling components of the ride system 10. For example, the instructions may cause the processing circuitry 54 to control vertical motion of the ride vehicle 20 by instructing the winches to drive motion of the pulley systems 34 to subject the ride passengers 22 to ride-enhancing motions. Furthermore, the instructions, when executed by the processing circuitry 54, may instruct a turntable or yaw drive system of the ride vehicle 20 to further enhance the overall ride experience by subjecting the ride passenger 22 to additional motion.

The storage device(s) 56 (e.g., nonvolatile storage) may include ROM, flash memory, a hard drive, or any other suitable optical, magnetic, or solid-state storage medium, or a combination thereof. The storage device(s) 56 may store ride system data (e.g., passenger information, data associated with the amusement park 8, data associated with a ride path trajectory), instructions (e.g., software or firmware for controlling the motion drive system 30 and/or the ride vehicle 20), and any other suitable information.

The ride system 10 may additionally or alternatively include a ride environment 60, which may include multiple and differing combinations of environments. The ride environment 60 may include the type of ride (e.g., dark ride, water coaster, roller coaster, VR experience, or any combination thereof) and/or associated characteristics (e.g., theming) of the type of ride. For example, the ride environment 60 may include aspects of the ride system 10 that add to the overall theming and/or experience associated with the ride system 10. The entertainment shows 40 may include content relevant to the theme associated with the ride environment 60.

The ride system 10 may additionally or alternatively include a motion-based environment 62 in which the ride passengers 22 are transported or moved by the ride system 10. For example, the motion-based environment 62 may include a flat ride 64 (e.g., a ride that moves the ride passengers 22 substantially within a plane that is generally aligned with the ground, such as by the ride vehicle 20 traveling along the ride path 12 toward the platform assembly 32). Additionally or alternatively, the motion based ride environment 62 may include a gravity ride 66 (e.g., a ride where motion of the ride passengers 22 has at least a component along the gravity vector, such as the motion generated via the motion drive system 30). Additionally or alternatively, the motion based ride environment 62 may include a vertical ride 68 (e.g., a ride that displaces the ride passengers 22 in a vertical plane around a fixed point, such as the vertical motion generated via the motion drive system).

The ride system 10 may additionally or alternatively include a motionless environment 70 in which the ride passengers 22 are not substantially transported or displaced by the ride system 10. For example, the motionless environment 70 may include a virtual reality (V/R) feature 72 (e.g., the ride passenger 22 may sit in a seat that vibrates or remains stationary while wearing a virtual reality (V/R) headset displaying a VR environment or experience) and/or a different kind of simulation 74. As another example, the motionless environment 70 may include a motion base. The ride vehicle 20 may come to a stop along the ride path 12, such that the ride experience may include aspects of the motionless ride environment 70 for a portion of the duration of the ride experience. While the motionless environment 70 may not substantially move the ride passengers 22, virtual reality and/or simulation effects may modify the perception of the ride passengers 22, which may be enhanced and contrasted by motion-based distortion experienced by ride passengers 22. To that end, it should be understood the ride system 10 may include both motion-based and motionless ride environments 62 and 70, which make the platform assembly 32 and the pulley system 34 desirable features, at least for enhancing the ride experience.

FIG. 2 is a perspective view of an embodiment of a ride system 10 employing the motion drive system 30 of FIG. 1, in accordance with aspects of the present disclosure. By employing the motion drive system 30, the experience of the passengers 22 may be improved. With this in mind, the ride system 10 may include multiple ride vehicles 20 coupled together via a linkage to join the ride passengers 22 riding in corresponding ride vehicles 20 in a common ride experience. In one example, ride vehicles 20 may be decoupled to one another, and may instead move independently of one another, for example, along respective and/or separate ride paths 12. In another example, the ride vehicles 20 may move as sets.

For example, a first set 20A of ride vehicles 20 (e.g., three ride vehicles) may move along a first ride path 12A and a second set 20B of ride vehicles 20 (e.g., five ride vehicles) may move along a second ride path 12B. The first ride path 12A may be on a level positioned lower than the second ride path 12B. The first ride path 12A may define a direction of travel for the ride vehicle 20 operating in a level below the second ride path 12B. The first ride path 12A may be positioned on the level on which a first entertainment show 40A is presented, and the second ride path may be positioned on a higher level on which a second entertainment show 40B is presented. The platform assembly 32 may receive the ride vehicles 20, individually or as sets (e.g., the first set or second set 20A, 20B), and the motion drive system 30 may transport the ride vehicle(s) 20 from along the first ride path 12A to the second ride path 12B or from any ride path 12 to any other ride path 12.

The control system 50 may instruct the motion drive system 30 to vertically displace the platform assembly 32 to transport the ride vehicle 20 from the first ride path 12A on the first level to the second ride path 12B on the second (e.g., higher) level, and thereby expose the ride passengers 22 to the first or second entertainment show 40A, 40B. Alternatively, the control system 50 may instruct the motion drive system 30 to vertically displace to transport the ride vehicle 20 from the first ride path 12A on the first level to the second ride path 12B on the second (e.g., higher) level and back to the first level, such that the ride vehicle 20 may continue to move along the first ride path 12A. In this manner, the control system 50 may expose the ride passengers 22 to a first entertainment show 40A, then the second entertainment show 40B, and then back to the first entertainment show 40A.

By employing the embodiments disclosed herein, the control system 50 may displace the ride vehicle 20 in a ride-enhancing manner to change a direction of travel (e.g., from along the first ride path 12A to the second ride path 12B). The motion drive system 30 may displace the ride passengers 22, while enhancing their ride experience, by subjecting the ride passenger 22 to the experience-enhancing motion described herein. It should be understood that the control system 50 may instruct the ride vehicles 20 to travel along the ride path 12 in any desired manner.

FIG. 3 is a flow diagram of an embodiment of a process 80 for controlling motion of the ride vehicle 20 (FIGS. 1, 2) operating in the ride system 10 of FIG. 2 by using the motion drive system of FIG. 1, in accordance with aspects of the present disclosure. The process 80 of the flow diagram may be implemented by the ride system 10 (FIG. 1, 2). In a non-limiting embodiment, the processing circuitry 54 (FIG. 1, 2) of the control system 50 (FIGS. 1, 2) may facilitate implementing the process 80. With the foregoing in mind, the control system 50 may instruct the ride system 10 to position (process block 81) the ride vehicle 20 on the platform assembly 32 (FIGS. 1, 2) at a target position on the platform assembly 32. The control system 50 may actuate the stopping device 26 (FIG. 1) to cause the ride vehicle 20 to stop on the platform assembly 32 at the position in which the ride vehicle 20 may engage with the securing device 28 (FIG. 1) to secure (process block 82) the ride vehicle 20. For example, the target position may be a position on the platform assembly 32 at which the securing device 28 may engage with compatible features of the ride vehicle 20 (e.g., female or male connectors) and thereby secure (process block 82) the ride vehicle 20 to the platform assembly 32.

The control system 50 may receive (process block 83) ride system data from the sensor assemblies 51 (FIG. 1) associated with the ride system 10 (FIGS. 1, 2) prior to, during, or after controlling motion of the platform assembly 32 and/or the ride vehicle 20. To facilitate control of the features in the ride system 10, the control system 50 may receive (process block 83) ride system data, such as a position, velocity, and acceleration of the ride vehicle 20 and platform assembly 32, information associated with the entertainment shows 40 (FIG. 1, 2), an engaging state (e.g., engaged or disengaged) of the stopping device 26 and securing device 28, a position, velocity, or acceleration of the pulley cables and/or winches of the pulley systems 34 (FIG. 1), an engaging state of the platform assembly 32, a position of the platform assembly 32, and the like. The control signals sent from the control system 50 to the various features of the amusement park 8 (FIG. 1) may be based on the ride system data, a subset of the ride system data, and/or any additional data.

The control signals may be used to coordinate (process block 84) motion of the ride vehicle 20 with the content of the entertainment shows 40. As mentioned above, control system 50 may control the motion drive system 30 to vertically transport the ride vehicle 20 and expose the ride passenger 22 to content on the plurality of entertainment shows 40.

The control system 50 may also control (process block 85) actuators on the ride vehicle 20 to cause motion of the ride vehicle 20. In an embodiment, the ride vehicle 20 may include a turntable, a yaw drive system, or any experience-enhancing motion-based platform allowing motion of a cab housing the ride passenger relative to a chassis of the ride vehicle 20. For example, the control system 50 may actuate the turntable, yaw drive system, or any experience-enhancing motion-based platform to cause the cab housing the ride passenger to move along or about a longitudinal, lateral, or vertical axis, thereby allowing six degrees-of-freedom motion of the cab relative to the chassis of the ride vehicle 20. In addition or alternatively, the ride system 20 may include a suspension system, which may dampen motion or vibrations while the ride vehicle 20 is in operation, for example, by absorbing vibration and reducing centrifugal forces when the ride vehicle 20 executes certain motions, such as turns, at certain velocities. The control system may control (process block 85) actuators associated with the suspension system to enhance the ride experience for ride passengers 22, for example, by stiffening, vibrating, or rotating components of the suspension system.

As set forth above, the ride system 10 may include the entertainment show 40 employing a plurality of levels accessible by the ride vehicle 20. Accordingly, the levels may be accessible to the ride vehicle 20 via the displacement resulting from the vertical motion in response to control signals received by the motion drive system 30 (FIG. 1, 2). After the ride vehicle 20 is secured to the platform assembly 32, the control system 50 may control the upward drive pulley system 36 (FIG. 1) to drive (process block 86) upward motion of the platform assembly 32 and ride vehicle 20. By vertically displacing the platform assembly 32, and thereby vertically displacing the ride vehicle 20, for example, from a first level to a second level, the control system 50 may control which entertainment show 40 the ride passenger 22 (FIG. 1, 2) is exposed to. For example, by controlling the upward drive pulley system 36 to drive (process block diagram 86) upward motion of the platform assembly 32 and ride vehicle 20, the control system 50 may cause the ride passenger 22 to be initially exposed to the first entertainment show 40A (FIG. 2) and subsequently to the second entertainment show 40B (FIG. 2) positioned on a level above the first entertainment show 40A.

In another example, by controlling the downward motion drive system 38, the control system may drive (process block 87) downward motion of the platform assembly 32 and the ride vehicle 20. By vertically displacing the platform assembly 32, and thereby vertically displacing the ride vehicle 20, for example, from a second level to a first level, the control system 50 may control which entertainment show 40 the ride passenger 22 (FIG. 1, 2) is exposed to. For example, by controlling the downward drive pulley system 38 to drive (process block diagram 87) downward motion of the platform assembly 32 and ride vehicle 20, the control system may cause the ride passenger 22 to be initially exposed to the second entertainment show 40B and subsequently to the first entertainment show 40A positioned on a level below the second entertainment show 40B.

After coordinating (process block 84) motion of the platform assembly 32 and the ride vehicle 20 with the entertainment shows 40 to execute a thrill-enhancing experience, the control system 50 may stop vertical motion of the platform assembly 32 and the ride vehicle, such that the platform assembly 32 mates with the ride path 12 (FIG. 1, 2) to further define the ride path 12 and allow (process block 88) the ride vehicle 20 to egress out of the platform assembly 32. After detaching from and egressing out from the platform assembly 32, the ride vehicle 20 may continue motion along the ride path 12. In an embodiment, the ride vehicle 20 may exit the platform assembly 32 onto a different ride path 12 from which it originally drove onto the platform assembly 32. As such, the motion drive system 30 may transport the ride vehicle 20 to another ride path 12 while exposing the ride passenger 22 to the plurality of entertainment shows 40 on various levels during the transportation.

Figure 4:
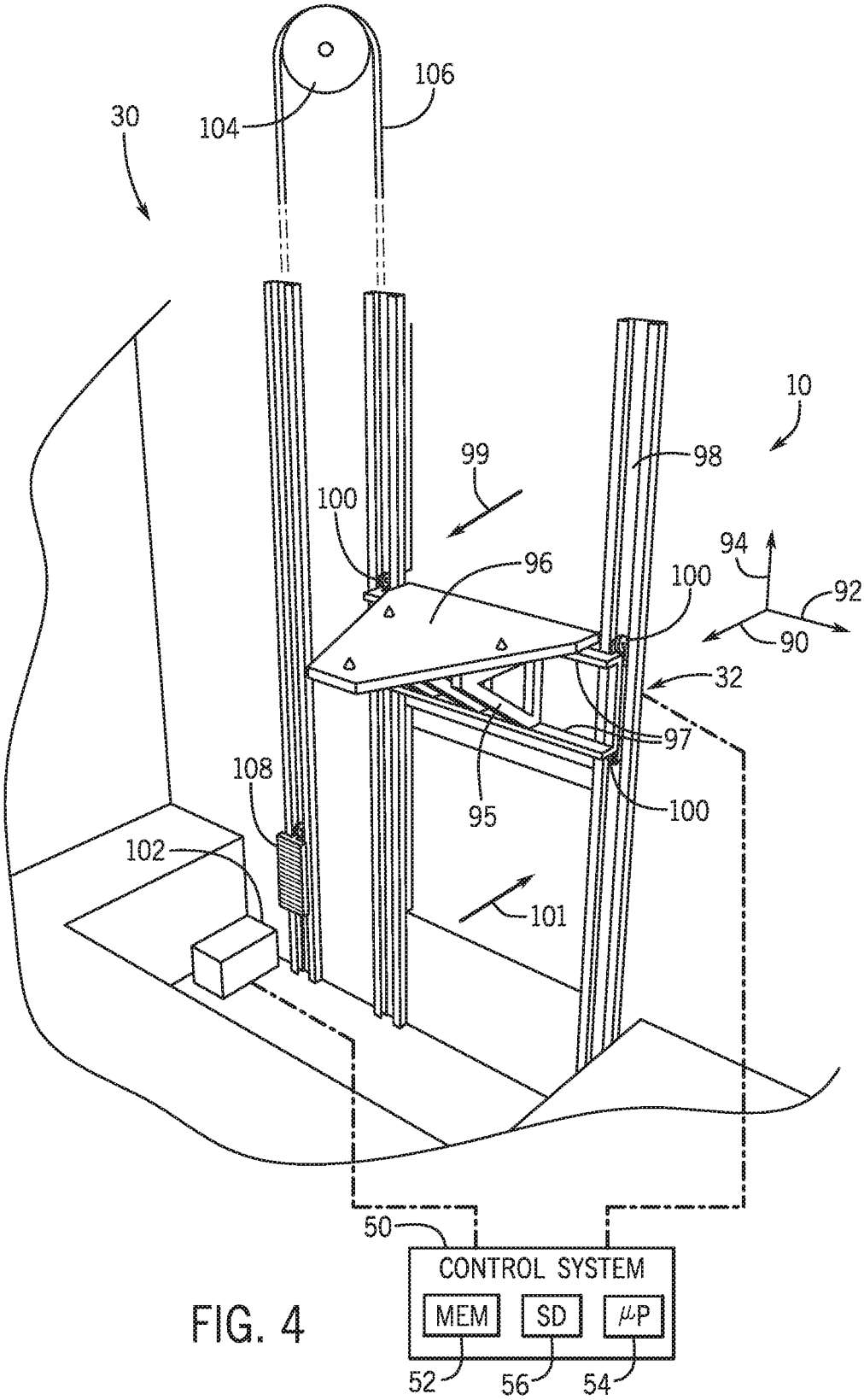
FIG. 4 is a cutaway perspective view of an embodiment of a platform assembly configured to support the ride vehicle of FIG. 3, in accordance with aspects of the present disclosure.

FIG. 4 is a cutaway perspective view of an embodiment of the platform assembly 32 configured to support the ride vehicle 20 of FIG. 3, in accordance with aspects of the present disclosure. To facilitate discussion, a coordinate system including a longitudinal axis 90, a lateral axis 92, and a vertical axis 94 (e.g., oriented parallel to a gravity vector) is illustrated. The platform assembly 32 may include one or more bracket members 95 to support a platform base 96. The bracket members 95 may be fixed to bar members 97 extending along the width of the platform base 96. The platform assembly 32 may include features, such as tracks or rails, to further define the ride path 12 (FIG. 1) and facilitate ingression and egression of the ride vehicle 20 into and out of the platform assembly, respectively.

In the illustrated embodiment, the platform base 96 may extend along the longitudinal axis 90 outward from vertical rails 98. While the ride vehicle 20 is supported by the platform assembly 32, the ride vehicle 20 may be positioned on the platform base 96. The platform base 96, bracket members 95, and bar members 97 may be manufactured out of any suitable material (e.g., steel alloy, copper, aluminum) configured to support at least the weight of the ride vehicle(s) 20, and the ride passengers 22 (FIGS. 1, 2). Furthermore, while the depicted platform base 96 is quadrilateral in shape, the platform base 96 may be of any suitable shape (e.g., circular, triangular, rectangular, octagonal, or round) that may support the ride vehicle(s) 20.

The platform assembly 32 may include vertical rails 98 that allow the platform base 96 to transport the platform base 96 along the vertical axis 94. For example, the platform assembly 32 may include a plurality of rollers 100 that engage with the vertical rails 98 and rotate about the lateral axis 92 to drive vertical motion of the platform base 96. Motion of the platform base 96 may be realized via a motor 102 communicatively coupled to the control system 50, such that the motor 102 may receive control signals to drive vertical motion of the platform base 96. The motor 102 may receive control signals from the control system 50 to control the current or voltage supplied to the vertical rails 98 to drive rotation of the rollers 100 and motion of the platform base 96. Alternatively, the motor 102 may receive control signals from the control system 50 to control a winch 104 that may drive motion of a pulley cable 106 coupled to the platform base 96. The platform assembly 32 may include a counterweight 108 that may reduce the force needed to control the vertical motion of the platform base 96. While motion of the platform base 96 is discussed as being driven via a motor system using a motor 102, the platform assembly 32 may include a pneumatic system, a motor system, a tire drive system, fins coupled to an electromagnetic drive system, a catapult system, and the like, to actively or passively drive the platform base 96. Further, the motor 102 may be integral or incorporated into the winch 104.

As described in detail below, the platform assembly 32 may receive a ride vehicle traveling along a first direction 99 from the second ride path 12 (FIG. 2). After securing the ride vehicle 20 to the platform base 96, the motor 102 may receive control signals from the control system 50 to control the current or voltage supplied to the vertical rails 98 to drive rotation of the rollers 100 and motion of the platform base 96. In this manner, the platform assembly 32 (specifically, the platform base 96) may vertically transport the ride vehicle 20 along the vertical axis 96. After vertically transporting the ride vehicle 20, the ride vehicle 20 may exit to the first ride path 12A (FIG. 2), for example, along direction 101.

Figure 5:
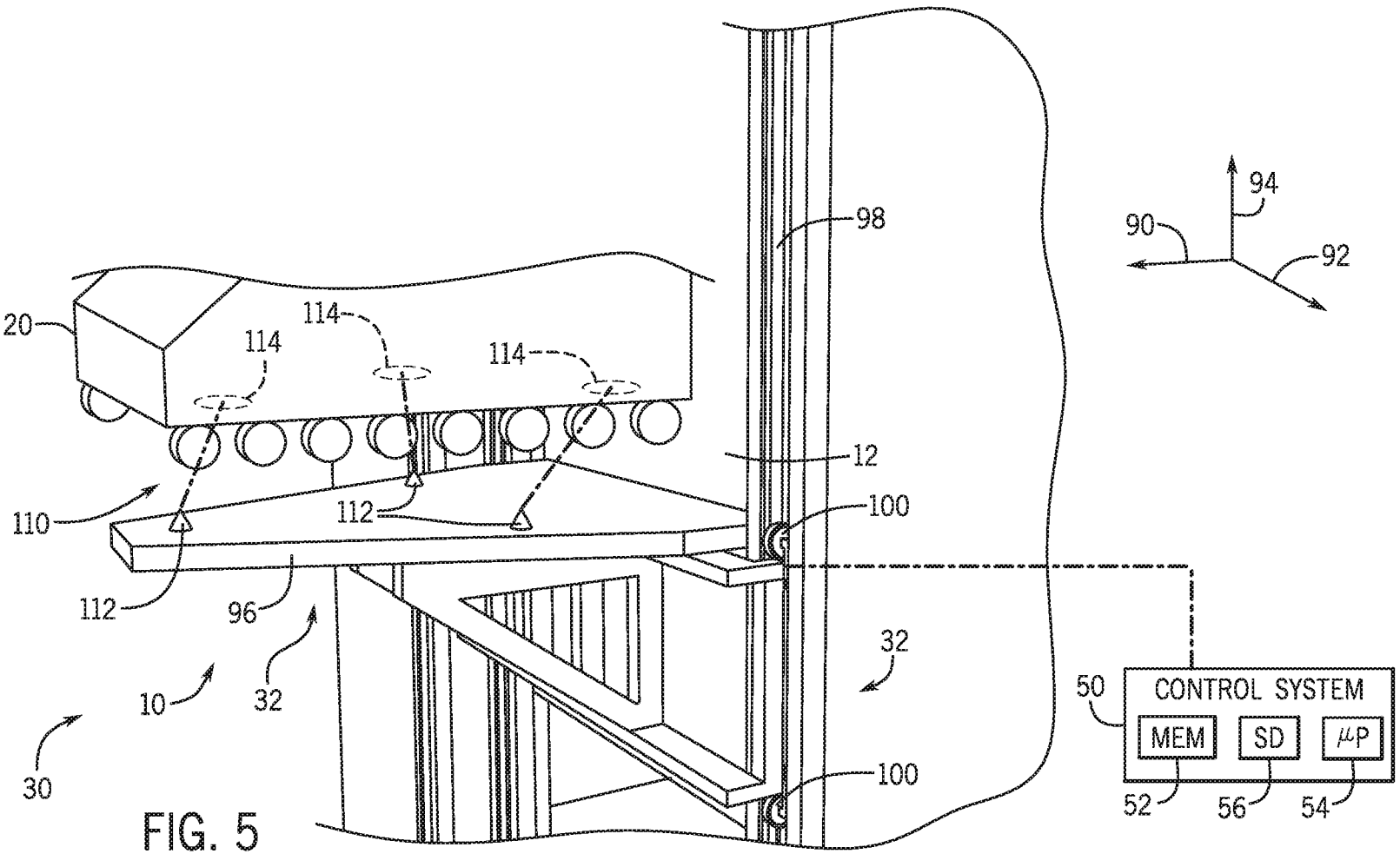
FIG. 5 is an expanded view of an embodiment of the platform assembly of FIG. 4 and an alignment mechanism configured to align the ride vehicle of FIG. 3, in accordance with aspects of the present disclosure.

FIG. 5 is an expanded view of an embodiment of the platform assembly 32 of FIG. 4 and an alignment mechanism 110 configured to align the ride vehicle 20 of FIG. 3 while supported by the platform assembly 32 of FIG. 4, in accordance with aspects of the present disclosure. The alignment mechanism 110 may include alignment pins 112 on the platform base 96 and openings 114 on the lower surface of the ride vehicle 20, such that the each of the alignment pins 112 may engage with a corresponding opening 114. The alignment pins 112 may have a conical contour that extends vertically upward from the platform base 96 along the vertical axis 94, and the corresponding openings 114 may have a similar contour to engage with the alignment pins 112. The conical contour of the alignment pins 112 and the openings 114 may mate with one another to facilitate transition from (tracks of) the ride path 12 toward the platform assembly 32. The alignment mechanism 110 may facilitate maintaining contact between the platform base 96 and the ride vehicle(s) 20, and prevent the ride vehicle(s) 20 from sliding or rotating off the platform assembly 32 (e.g., by rotating about the vertical axis 94, the longitudinal axis 90, and the lateral axis 92).

Although not illustrated, the securing mechanism that secures the ride vehicle 20 to the platform assembly 32 (e.g., to the platform base 96) may be positioned on the platform base 96 and be enhanced by the alignment mechanism 110. In an embodiment, the securing mechanism of the platform assembly 32 may be integral to the alignment mechanism 110.

FIG. 6 is a side elevation view of an embodiment of the motion drive system 30 operating in the ride system 10 of FIG. 2, in accordance with aspects of the present disclosure. The motion drive system 30 includes an embodiment of the upward drive pulley system 36 and the downward pulley drive system 38. It should be understood that the arrangement and size of the various features in FIGS. 6-8 are illustrated to facilitate discussion, and some features may be hidden to the ride passenger 22 (FIG. 1, 2), for example, because the features may be positioned below ground level, behind walls, and so forth.

With this in mind, the upward drive pulley system 36 may include a plurality of upward drive winches 150, of which, a subset may be actuatable upward drive winches. The actuatable upward drive winches may receive a control signal instructing the drive winches to rotate in a first rotational drive direction 152 and thereby drive upward motion (e.g., along the vertical axis 94) of the platform assembly 32 and the ride vehicle 20 by driving motion of a pulley cable 158.

The downward drive pulley system 38 may include a plurality of downward drive winches 160, of which, a subset may be actuatable downward drive winches. That is, the actuatable downward drive winches may receive a control signal instructing the actuatable downward drive winches to rotate in a second rotational drive direction 162 and thereby drive downward motion (e.g., along the vertical axis 94) of the platform assembly 32 and the ride vehicle 20 by driving motion of the pulley cable 158. One or more of the plurality of upward drive winches may freely rotate in any direction (e.g., in the first or second direction 152, 162). These winches that may freely rotate may be associated with the upward drive pulley system 36, the downward drive pulley system 38, or both. While the illustrated embodiment depicts the pulley cable 158 as common to both the upward drive pulley system 36 and the downward drive pulley system 38, it should be understood that the upward drive pulley system 36 and the downward drive pulley system 38 may include respective pulley cables.

Furthermore, to prevent the upward drive pulley system 36 and the downward drive pulley system 38 from interfering with one another (e.g., working against one another), the motion drive system 30 may include any suitable regulating device, such as a clutch system 170. The clutch system 170 may receive control signals causing the clutch system 170 to selectively engage with the upward drive winches 150 or the downward drive winches 160. For example, when the clutch system 170 engages the upward drive winch 150, the upward drive pulley system 36 may drive upward motion (e.g., along the vertical axis 94) of the platform assembly 32 and the ride vehicle 20. In another example, when the clutch system 170 engages the downward drive winch 160, the downward drive pulley system 38 may drive downward motion (e.g., along the vertical axis 94) of the platform assembly 32 and the ride vehicle 20.

The ride system 10 may include a counterweight mechanism 180 that includes a counterweight 182 and a counterweight pulley cable 184 that are movable via counterweight winches 186. The counterweight mechanism 180 may serve to reduce the torque needed by the upward or downward drive winch 150, 160 to drive vertical motion of the platform assembly 32 and the ride vehicle 20. In this manner, the torque output required by the upward or downward drive winch 150, 160 to drive vertical motion of the platform assembly 32 and ride vehicle 20 may be less than it would be absent the counterweight mechanism 180, thereby reducing the total load on the upward and downward drive winch 150, 160 during motion of the platform assembly 32 and the ride vehicle 20. The counterweight mechanism 180 may couple to the platform assembly 32.

The ride system 10 may include a tension system 190 that includes one or more tensioning mechanisms 192 that may maintain the transfer of loads from the upward and downward drive winch 150, 160 to the platform assembly 32 and the ride vehicle 20. Examples of the tensioning mechanism 192 include a compact tensioner, a structural tension cable assembly, bow struts, bow tensile fabric structure boundary cables, and so forth. The tensioning mechanism 192 may (partially define or) be a part of the pulley cable 158. Alternatively, the tensioning mechanism 192 may be used in conjunction with the pulley cable 158.

FIG. 7 is a side elevation view of an embodiment of the motion drive system 30 of FIG. 6 configured to coordinate motion in a ride environment 200 associated with the ride system 10 of FIG. 2. In the illustrated ride environment 200, the platform assembly 32 may receive the ride vehicle 20 from the ride path 12. After instructing the ride vehicle 20 to stop on the platform assembly 32, the control system 50 may send a first control signal to the upward drive pulley system 36 (to drive upward motion) or to the downward drive pulley system 38 (to drive downward motion) and a second control signal to the first or second entertainment shows 40A, 40B, such that motion of the ride vehicle 20 is coordinated with the entertainment shows 40. As discussed above, the entertainment shows 40 may include a visual projection, a screen configured to display relevant theming content, a group of a plurality of actors performing a skit, an experience enhancing visualization, or any combination thereof. As illustrated, the first entertainment show 40A is on a first level 212 and the second entertainment show 40B is on a second level 214.

For example, while the ride vehicle 20 is positioned or operating within a first vertical distance range 202 (e.g., as determined by the control system 50 based on feedback from sensor assemblies 51 (FIG. 1)) defined between the first and second levels 212, 214, the control system 50 may send the second signal to the first entertainment show 40A to execute the first show. The control system 50 may instruct the motion drive system 30 to drive upward or downward motion of the platform assembly 32 and the ride vehicle 20. While the ride vehicle 20 is positioned within the first vertical distance range 202, the control system 50 may also actuate the turntable, the yaw drive system, or any experience-enhancing motion-based platform to allow motion of the cab housing the ride passenger 22 (FIG. 1, 2) relative to the chassis and to execute the first show, thereby further enhancing the ride experience. For example, the experience-enhancing motion-based platform may rotate and tilt the cab relative to the chassis about the lateral axis 92 to better orient the ride passenger 22 toward the first show. The motion drive system 30 may cause the ride vehicle 20 to traverse the first vertical distance range 202 in any suitable amount of time (e.g., three seconds, five seconds, ten seconds, and so forth). While the ride vehicle 20 is operating within the first vertical distance range 202, the second show may include elements on any space within the first vertical distance range 202 such as on the walls, on the floor of the first level 212, on the roof (e.g., underside of the second level 214), in the air, and so forth.

While the ride vehicle 20 is positioned or operating within a second vertical distance range 204 (e.g., as determined by the control system 50 based on feedback from sensor assemblies 51) defined by the space above the second level 214, the control system 50 may send the second signal to the second entertainment show 40B to execute the second show. In response to the control system 50 instructing the motion drive system 30 to drive upward or downward motion of the platform assembly 32 and the ride vehicle 20, and while the ride vehicle 20 is positioned within the second vertical distance range 204, the control system 50 may actuate the turntable, the yaw drive system, or any experience-enhancing motion-based platform allowing motion of a cab housing the ride passenger 22 relative to the chassis, in addition to executing the second show, thereby further enhancing the ride experience. For example, the experience-enhancing motion-based platform may rotate and tilt the cab relative to the chassis about the lateral axis 92 to expose the ride passenger 22 to the second show. The motion drive system 30 may cause the ride vehicle 20 to traverse the second vertical distance range 204 in any suitable amount of time (e.g., three seconds, five seconds, ten seconds, and so forth). While the ride vehicle 20 is operating within the second vertical distance range 204, the second show may include elements on any space within the second vertical distance range 204 such as on the walls, on the floor of the second level 214, on the roof, in the air, and so forth.

It should be understood that, while in the illustrated embodiment the ride environment 200 includes two levels with an entertainment show 40 on each level, in another embodiment, the ride system 10 may include any number of levels defining any number of vertical distance ranges. For example, the ride system 10 may include three levels, four levels, five levels, and so forth.

FIG. 8 is a side elevation view of an embodiment of the motion drive system of FIG. 6 configured to coordinate motion in another ride environment 220, in accordance with aspects of the present disclosure. As illustrated, the level on which the first and second entertainment shows are presented may include a portion of the ride path 12 on which the ride vehicle 20 may travel. For example, the first entertainment show 40A may be positioned on a first level that includes the first ride path 12A. As illustrated, the platform assembly 32 may receive the ride vehicle 20 from the first ride path 12A and the control system 50 may instruct the platform assembly 32 to stop and secure the ride vehicle 20. Thereafter, the ride vehicle 20 may be vertically displaced by the motion drive system 30. After the motion drive system 30 vertically displaces the ride vehicle 20, the control system 50 may instruct the motion drive system 30 to stop at a positon in which the platform assembly 32 may further define the first ride path 12A, such that the ride vehicle 20 may decouple from the platform assembly 32 and continue along the first ride path 12A, while the first entertainment show 40A continues to present the first show. That is, the first entertainment show 40A may execute the first show while the ride vehicle 20 is within the first vertical distance range 202 or when the ride vehicle 20 exits the platform assembly 32 and continues to travel along the first ride path 12A.

Additionally, the motion drive system 30 may transport the ride vehicle 20 from the first ride path 12A to the second ride path 12B. After the motion drive system 30 vertically displaces the ride vehicle 20, the control system 50 may instruct the motion drive system 30 to stop at a positon in which the platform assembly 32 may further define the second ride path 12B, such that the ride vehicle 20 may decouple from the platform assembly 32 and egress onto the second ride path 12B, while the second entertainment show 40B continues to present the second show. That is, the second entertainment show 40B may execute the second show while the ride vehicle 20 is within the second vertical distance range 204 or when the ride vehicle 20 exits the platform assembly 32 and continues to travel along the second ride path 12B.

While only certain features of the disclosed embodiments have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An amusement park ride system configured to control ride vehicle motion, the amusement park ride system comprising:

a platform assembly configured to receive a ride vehicle of the amusement park ride system;

an upward drive pulley system coupled to the platform assembly and configured to upwardly drive motion of the platform assembly along a vertical axis oriented along a gravity vector;

a downward drive pulley system coupled to the platform assembly and configured to downwardly drive the motion of the platform assembly along the vertical axis; and a clutch system configured to selectively engage the upward drive pulley system and the downward drive pulley system, wherein the motion of the platform assembly is restricted to being along an upward direction along the vertical axis when the clutch system engages the upward drive pulley system, and wherein the motion of the platform assembly is restricted to being along a downward direction along the vertical axis when the clutch system engages the downward drive pulley system.

2. The amusement park ride system of claim 1, comprising:

a control system communicatively coupled to the platform assembly, the upward drive pulley system, and the downward drive pulley system, wherein the control system comprises processing circuitry and memory circuitry storing instructions thereon, wherein the instructions are configured to be executed by the processing circuitry, and wherein the instructions are configured to cause the processing circuitry to:

instruct a securing device of the platform assembly to secure the ride vehicle to the platform assembly;

selectively actuate an upward drive winch of the upward drive pulley system and selectively actuate a downward drive winch of the downward drive pulley system, thereby controlling the motion of the platform assembly and the ride vehicle motion, in response to determining that the securing device secures the ride vehicle to the platform assembly; and allow egression of the ride vehicle out from the platform assembly by disengaging the securing device.

3. The amusement park ride system of claim 1, wherein:

the upward drive pulley system comprises an upward drive winch drivingly coupled to an upward drive pulley cable, and wherein the upward drive winch is configured to rotate in a first rotational direction to upwardly drive the motion of the platform assembly; and the downward drive pulley system comprises a downward drive winch drivingly coupled to a downward drive pulley cable, and wherein the downward drive winch is configured to rotate in a second rotational direction, opposite the first rotational direction, to downwardly drive the motion of the platform assembly.

4. The amusement park ride system of claim 1, wherein a plurality of entertainment shows are visible to a ride passenger in response to the upward drive pulley system upwardly driving the motion of the platform assembly, the downward drive pulley system downwardly driving the motion of the platform assembly, or any combination thereof.

5. The amusement park ride system of claim 4, wherein the plurality of entertainment shows comprise a visual projection, a screen configured to display relevant theming content, an experience enhancing visualization, or any combination thereof.

6. The amusement park ride system of claim 1, wherein a first entertainment show of a plurality of entertainment shows is positioned on a first level, wherein a second entertainment show of the plurality of entertainment shows is positioned on a second level, wherein the second level is positioned vertically higher than the first level, and wherein the amusement park ride system is configured to transition the platform assembly between the first level and the second level.

7. The amusement park ride system of claim 6, wherein the first entertainment show remains hidden from a ride passenger while the ride passenger is exposed to the second entertainment show, and wherein the second entertainment show remains hidden from the ride passenger while the ride passenger is exposed to the first entertainment show.

8. The amusement park ride system of claim 1, wherein the platform assembly is configured to receive the ride vehicle from a first ride path, and wherein the platform assembly is configured to allow egress of the ride vehicle out toward a second ride path.

9. The amusement park ride system of claim 8, wherein the second ride path is positioned on a level above the first ride path, wherein the upward drive pulley system is configured to transport the ride vehicle from the first ride path to the second ride path by upwardly driving the motion of the platform assembly.

10. The amusement park ride system of claim 1, wherein the platform assembly is configured to be upwardly and downwardly driven to expose a ride passenger to a plurality of entertainment shows, and wherein the entertainment shows of the plurality of entertainment shows are positioned on a different vertical level with respect to one another.

11. A method for controlling ride vehicle motion of a ride vehicle of an amusement park ride system, the method comprising:

positioning and securing the ride vehicle on a platform assembly drivingly coupled to a motion drive system, wherein the platform assembly is configured to receive the ride vehicle, wherein the motion drive system comprises an upward drive pulley system configured to drive motion of the platform assembly in an upward direction along a vertical axis oriented along a gravity vector and a downward drive pulley system configured to drive the motion of the platform assembly in a downward direction along the vertical axis; and coordinating the ride vehicle motion with a plurality of entertainment shows positioned on corresponding levels by vertically displacing the platform assembly;

wherein coordinating the ride vehicle motion comprises instructing a first entertainment show of the plurality of entertainment shows to execute a first show in response to the ride vehicle being positioned within a first vertical distance range;

wherein coordinating the ride vehicle motion comprises instructing a second entertainment show of the plurality of entertainment shows to execute a second show in response to the ride vehicle being positioned within a second vertical distance range;

wherein the second vertical distance range is above the first vertical distance range;

wherein the ride vehicle is configured to transition from the first vertical distance range to the second vertical distance range in response to the upward drive pulley system driving the motion of the platform assembly in the upward direction, and wherein a clutch system is configured to selectively engage the upward drive pulley system to restrict the ride vehicle motion along the upward direction along the vertical axis; and wherein the ride vehicle is configured to transition from the second vertical distance range to the first vertical distance range in response to the downward drive pulley system driving the motion of the platform assembly in the downward direction, and wherein the clutch system is configured to selectively engage the downward drive pulley system to restrict the ride vehicle motion along the downward direction along the vertical axis.

12. The method of claim 11, wherein positioning and securing the ride vehicle on the platform assembly comprises receiving the ride vehicle from a first ride path on a first level.

13. The method of claim 11, comprising instructing, via a control system, the ride vehicle to egress out from the platform assembly onto a second ride path on a second level positioned above a first level after upwardly driving the motion of the platform assembly from the first level to the second level.

14. The method of claim 11, comprising instructing, via a control system, actuators of the ride vehicle to drive motion of a cab of the ride vehicle relative to a chassis of the ride vehicle, wherein the cab is configured to house a ride passenger, wherein the motion of the cab relative to the chassis causes the ride passenger to move relative to the chassis along or about a longitudinal, lateral, or the vertical axis.

15. An amusement park ride system configured to control ride vehicle motion, the amusement park ride system comprising:

a ride vehicle of the amusement park ride system configured to transport a ride passenger; and a motion drive system, comprising:

a platform assembly comprising a roller assembly, the roller assembly configured to enable motion of the platform assembly;

an upward drive pulley system drivingly coupled to the platform assembly and configured to upwardly drive the motion of the platform assembly along a vertical axis oriented along a gravity vector;

a downward drive pulley system drivingly coupled to the platform assembly and configured to downwardly drive the motion of the platform assembly along the vertical axis; and a clutch system configured to selectively engage the upward drive pulley system and the downward drive pulley system, wherein the motion of the platform assembly is restricted to being along an upward direction along the vertical axis when the clutch system engages the upward drive pulley system, and wherein the motion of the platform assembly is restricted to being along a downward direction along the vertical axis when the clutch system engages the downward drive pulley system.

16. The amusement park ride system of claim 15, comprising:

a control system communicatively coupled to the platform assembly, the upward drive pulley system, and the downward drive pulley system, wherein the control system comprises processing circuitry and memory circuitry, the memory circuitry configured to have instructions stored thereon, wherein the instructions are configured to be executed by the processing circuitry, and wherein the instructions are configured to cause the processing circuitry to:

instruct the ride vehicle to decelerate onto the platform assembly before stopping at a target position on the platform assembly;

instruct a securing device to secure the ride vehicle to the platform assembly at the target position;

selectively actuate an upward drive winch of the upward drive pulley system and selectively actuate a downward drive winch of the downward drive pulley system, thereby controlling the motion of the platform assembly, and the ride vehicle motion, in response to determining that the securing device secures the ride vehicle to the platform assembly; and allow egression of the ride vehicle from the platform assembly by disengaging the securing device after completion of the selective actuation.

17. The amusement park ride system of claim 15, wherein a first entertainment show of a plurality of entertainment shows is positioned on a first level, wherein a second entertainment show of the plurality of entertainment shows is positioned on a second level, wherein the second level is positioned vertically higher than the first level, and wherein the amusement park ride system is configured to transition the platform assembly between the first level and the second level.

18. The amusement park ride system of claim 17, wherein the first entertainment show remains hidden from the ride passenger while the ride passenger is exposed to the second entertainment show, and wherein the second entertainment show remains hidden from the ride passenger while the ride passenger is exposed to the first entertainment show.

19. The amusement park ride system of claim 15, wherein the platform assembly is configured to be upwardly and downwardly driven to expose the ride passenger to a plurality of entertainment shows, and wherein the entertainment shows of the plurality of entertainment shows are positioned on a different vertical level with respect to one another.

20. The amusement park ride system of claim 19, wherein the plurality of entertainment shows comprise a visual projection, a screen configured to display relevant theming content, an experience enhancing visualization, or any combination thereof.

* * * * *